US011234572B2

(12) United States Patent
Harting et al.

(10) Patent No.: US 11,234,572 B2
(45) Date of Patent: Feb. 1, 2022

(54) DOCKING STATION FOR ROBOTIC CLEANER

(71) Applicant: SharkNinja Operating, LLC, Needham, MA (US)

(72) Inventors: David Harting, Mansfield, MA (US); Jason B. Thorne, Dover, MA (US)

(73) Assignee: SharkNinja Operating LLC, Needham, MA (US)

( * ) Notice: Subject to any disclaimer, the term of this patent is extended or adjusted under 35 U.S.C. 154(b) by 121 days.

(21) Appl. No.: 16/827,216

(22) Filed: Mar. 23, 2020

(65) Prior Publication Data

US 2020/0214524 A1 Jul. 9, 2020

Related U.S. Application Data

(63) Continuation of application No. 16/400,657, filed on May 1, 2019, now Pat. No. 10,595,696.

(60) Provisional application No. 62/665,364, filed on May 1, 2018.

(51) Int. Cl.
*A47L 9/28* (2006.01)
*A47L 11/40* (2006.01)

(52) U.S. Cl.
CPC ..... *A47L 9/2873* (2013.01); *A47L 11/4025* (2013.01); *A47L 11/4027* (2013.01); *A47L 2201/024* (2013.01)

(58) Field of Classification Search
CPC ..... A47L 9/2873; A47L 11/4025; A47L 11/4027; A47L 2201/024
See application file for complete search history.

(56) References Cited

U.S. PATENT DOCUMENTS

| | | | |
|---|---|---|---|
| 3,425,192 | A | 2/1969 | Mitchell |
| 3,543,325 | A | 12/1970 | Hamrick |
| 4,679,152 | A | 7/1987 | Perdue |
| 4,846,297 | A | 7/1989 | Field et al. |
| 5,032,775 | A | 7/1991 | Mizuno et al. |
| 5,083,704 | A | 1/1992 | Rounthwaite |

(Continued)

FOREIGN PATENT DOCUMENTS

| | | | |
|---|---|---|---|
| CA | 978485 | A | 11/1975 |
| CN | 1679439 | B | 10/2005 |

(Continued)

OTHER PUBLICATIONS

U.S. Appl. No. 60/807,442 titled Bin Full Detector filed Jul. 14, 2006.

(Continued)

*Primary Examiner* — Weilun Lo
(74) *Attorney, Agent, or Firm* — Grossman Tucker Perreault & Pfleger, PLLC

(57) ABSTRACT

A docking station for a robotic vacuum cleaner may include a suction motor, a collection bin, and a filter system fluidly coupled to the suction motor. The suction motor may be configured to suction debris from a dust cup of the robotic vacuum cleaner. The filter system may include a filter medium to collect debris suctioned from the dust cup, a compactor configured to urge a first portion of the filter medium towards a second portion of the filter medium such that a closed bag can be formed, and a conveyor configured to urge the closed bag into the collection bin.

20 Claims, 9 Drawing Sheets

(56) References Cited

U.S. PATENT DOCUMENTS 5,135,552 A 8/1992 Weistra
5,769,572 A 6/1998 Pfeiffer
5,787,545 A 8/1998 Colens
6,076,226 A 6/2000 Schaap
6,122,796 A 9/2000 Downham et al.
6,327,741 B1 12/2001 Schaap
6,553,612 B1 4/2003 Dyson
6,582,489 B2 6/2003 Conrad
6,600,899 B1 7/2003 Radomsky et al.
6,607,572 B2 8/2003 Gammack et al.
6,625,845 B2 9/2003 Matsumoto et al.
6,629,028 B2 9/2003 Riken
6,811,584 B2 11/2004 Oh
6,818,036 B1 11/2004 Seaman
6,824,580 B2 11/2004 Oh
6,835,222 B2 12/2004 Gammack
6,928,692 B2 8/2005 Oh et al.
6,968,592 B2 11/2005 Takeuchi et al.
7,024,278 B2 4/2006 Chiappetta et al.
7,055,210 B2 6/2006 Keppler
7,070,636 B2 7/2006 McCormick et al.
7,124,680 B2 10/2006 Poss
7,133,746 B2 11/2006 Abramson et al.
7,152,276 B2 12/2006 Jin et al.
7,152,277 B2 12/2006 Jung et al.
7,188,000 B2 3/2007 Chiappetta et al.
7,196,487 B2 3/2007 Jones et al.
7,218,994 B2 5/2007 Kanda et al.
7,227,327 B2 6/2007 Im
7,247,181 B2 7/2007 Hansen et al.
7,291,190 B2 11/2007 Dummelow et al.
7,294,159 B2 11/2007 Oh et al.
7,318,249 B2 1/2008 Lin
7,318,848 B2 1/2008 Lee
7,332,005 B2 2/2008 Wegelin
7,332,890 B2 2/2008 Cohen et al.
7,335,241 B2 2/2008 Oh et al.
7,351,269 B2 4/2008 Yau
7,412,748 B2 8/2008 Lee et al.
7,412,749 B2 8/2008 Thomas et al.
7,418,762 B2 9/2008 Arai et al.
7,419,520 B2 9/2008 Lee et al.
7,457,399 B2 11/2008 Onken
7,473,289 B2 1/2009 Oh et al.
7,481,160 B1 1/2009 Simon
7,494,520 B2 2/2009 Nam et al.
7,494,523 B2 2/2009 Oh et al.
7,526,362 B2 4/2009 Kim et al.
7,543,708 B2 6/2009 Doyle et al.
7,547,336 B2 6/2009 Fester et al.
7,547,337 B2 6/2009 Oh et al.
7,547,338 B2 6/2009 Kim et al.
7,611,553 B2 11/2009 Hato
7,704,290 B2 4/2010 Oh
7,706,917 B1 4/2010 Chiappetta et al.
7,720,554 B2 5/2010 DiBernardo et al.
7,729,801 B2 6/2010 Abramson
7,776,116 B2 8/2010 Oh et al.
7,779,504 B2 8/2010 Lee et al.
7,827,653 B1 11/2010 Liu et al.
7,849,555 B2 12/2010 Hahm et al.
7,861,366 B2 1/2011 Hahm et al.
7,887,613 B2 2/2011 Ruben
7,891,045 B2 2/2011 Kim et al.
7,996,097 B2 8/2011 DiBernardo et al.
7,996,126 B2 8/2011 Hong
8,019,223 B2 9/2011 Hudson et al.
8,029,590 B2 10/2011 Cheng
8,065,778 B2 11/2011 Kim et al.
8,087,117 B2 1/2012 Kapoor et al.
8,229,593 B2 7/2012 Rodriguez et al.
8,239,992 B2 8/2012 Schnittman et al.
8,310,684 B2 11/2012 Lee et al.
8,316,499 B2 11/2012 Dooley et al.
8,341,802 B2 1/2013 Kim et al.
8,368,339 B2 2/2013 Jones
8,374,721 B2 2/2013 Halloran
8,380,350 B2 2/2013 Ozick
8,390,251 B2 3/2013 Cohen
8,418,303 B2 4/2013 Kapoor
8,438,694 B2 5/2013 Kim
8,438,698 B2 5/2013 Kim
8,452,450 B2 5/2013 Dooley
8,461,803 B2 6/2013 Cohen
8,528,157 B2 9/2013 Schnittman
8,549,704 B2 10/2013 Milligan
8,572,799 B2 11/2013 Won
8,584,305 B2 11/2013 Won
8,590,101 B2 11/2013 Liu
8,591,615 B2 11/2013 Kim
8,606,404 B1 12/2013 Huffman
8,627,542 B2 1/2014 Kim
8,634,956 B1 1/2014 Chiappetta
8,634,958 B1 1/2014 Chiappetta
8,635,739 B2 1/2014 Lee
8,650,703 B2 2/2014 Kim et al.
8,657,904 B2 2/2014 Smith
8,688,270 B2 4/2014 Roy et al.
8,695,159 B2 4/2014 Van Der Kooi
8,707,512 B2 4/2014 Horne
8,732,901 B2 5/2014 Shim
8,741,013 B2 6/2014 Swett
8,742,926 B2 6/2014 Schnittman
8,749,196 B2 6/2014 Cohen
8,756,751 B2 6/2014 Jung
8,763,201 B2 7/2014 Kim
8,782,850 B2 7/2014 Yoo
8,806,708 B2 8/2014 Sutton
8,826,492 B2 9/2014 Dyson
8,854,001 B2 10/2014 Cohen
8,857,012 B2 10/2014 Kim et al.
8,863,353 B2 10/2014 Smith
8,869,338 B1 10/2014 Dooley et al.
8,870,988 B2 10/2014 Oh
8,918,209 B2 12/2014 Rosenstein
8,926,723 B2 1/2015 Kim
8,930,023 B2 1/2015 Gutmann
8,945,258 B2 2/2015 Smith
8,951,319 B2 2/2015 Kim
8,954,192 B2 2/2015 Ozick
8,972,052 B2 3/2015 Chiappetta
8,979,960 B2 3/2015 Smith
8,984,708 B2 3/2015 Kuhe
8,984,712 B2 3/2015 Peng
9,005,324 B2 4/2015 Smith
9,005,325 B2 4/2015 Smith
9,008,835 B2 4/2015 Dubrovsky
9,027,199 B2 5/2015 Jung
9,044,125 B2 6/2015 Follows
9,044,126 B2 6/2015 Dyson
9,060,666 B2 6/2015 Jang
9,131,818 B2 9/2015 Peace et al.
9,144,360 B2 9/2015 Ozick
9,146,560 B2 9/2015 Burnett
9,149,170 B2 10/2015 Ozick
9,178,370 B2 11/2015 Henricksen et al.
9,192,272 B2 11/2015 Ota
9,204,771 B2 12/2015 Gammack
9,215,957 B2 12/2015 Cohen et al.
9,229,454 B1 1/2016 Chiappetta et al.
9,233,471 B2 1/2016 Schnittman et al.
9,282,863 B2 3/2016 Follows
9,354,634 B2 5/2016 Ko
9,360,300 B2 6/2016 DiBernado et al.
9,375,842 B2 6/2016 Shamlian et al.
9,380,922 B2 7/2016 Duffley et al.
9,402,524 B2 8/2016 Yoon
9,420,741 B2 8/2016 Balutis et al.
9,423,798 B2 8/2016 Liu et al.
9,439,547 B2 9/2016 Makarov
9,462,920 B1 * 10/2016 Morin ..... A47L 9/149
9,468,349 B2 10/2016 Fong et al.
9,476,771 B2 10/2016 Teng et al.
9,486,924 B2 11/2016 Dubrovsky et al.

(56) References Cited

U.S. PATENT DOCUMENTS

| | | | | |
|---|---|---|---|---|
| 9,492,048 | B2 | 11/2016 | Won et al. | |
| 9,504,365 | B2 | 11/2016 | Kim et al. | |
| 9,510,717 | B2 | 12/2016 | Ko | |
| 9,521,937 | B2 | 12/2016 | Follows | |
| 9,526,391 | B2 | 12/2016 | Lee | |
| 9,529,363 | B2 | 12/2016 | Chiappetta | |
| 9,538,702 | B2 | 1/2017 | Balutis et al. | |
| 9,538,892 | B2 | 1/2017 | Fong et al. | |
| 9,550,294 | B2 | 1/2017 | Cohen et al. | |
| 9,572,467 | B2 | 2/2017 | Dyson et al. | |
| 9,591,957 | B2 | 3/2017 | Dyson et al. | |
| 9,599,990 | B2 | 3/2017 | Halloran et al. | |
| 9,613,308 | B2 | 4/2017 | Izhikevich et al. | |
| 9,630,317 | B2 | 4/2017 | Izhikevich et al. | |
| 9,675,229 | B2 | 6/2017 | Kwak et al. | |
| 9,704,043 | B2 | 7/2017 | Schnittman | |
| 9,757,004 | B2 | 9/2017 | Neumann et al. | |
| 9,788,698 | B2 | 10/2017 | Morin et al. | |
| 9,826,678 | B2 | 11/2017 | Balutis et al. | |
| 9,826,871 | B2 | 11/2017 | Jang et al. | |
| 9,826,872 | B2 | 11/2017 | Schnittman et al. | |
| 9,826,873 | B2 | 11/2017 | Abe et al. | |
| 9,840,003 | B2 | 12/2017 | Szatmary et al. | |
| 9,866,035 | B2 | 1/2018 | Doughty et al. | |
| 9,884,423 | B2 | 2/2018 | Cohen et al. | |
| 9,888,818 | B2 | 2/2018 | Kuhe et al. | |
| 9,901,236 | B2 | 2/2018 | Halloran et al. | |
| 9,904,284 | B2 | 2/2018 | Kwak et al. | |
| 9,907,447 | B2 | 3/2018 | Tanaka et al. | |
| 9,924,846 | B2 | 3/2018 | Morin et al. | |
| 9,931,007 | B2 | 4/2018 | Morin et al. | |
| 9,931,012 | B2 | 4/2018 | Ichikawa et al. | |
| 9,955,841 | B2 | 5/2018 | Won et al. | |
| 9,968,232 | B2 | 5/2018 | Watanabe et al. | |
| 10,398,272 | B2 | 9/2019 | Hyun et al. | |
| 10,463,215 | B2 * | 11/2019 | Morin | A47L 9/2857 |
| 2002/0078524 | A1 | 6/2002 | Schroter | |
| 2003/0159235 | A1 | 8/2003 | Oh | |
| 2004/0163206 | A1 | 8/2004 | Oh | |
| 2004/0255425 | A1 | 12/2004 | Arai et al. | |
| 2005/0011037 | A1 | 1/2005 | Zhao et al. | |
| 2005/0015920 | A1 | 1/2005 | Kim | |
| 2005/0150519 | A1 | 7/2005 | Keppler | |
| 2007/0157415 | A1 | 7/2007 | Lee et al. | |
| 2007/0157420 | A1 | 7/2007 | Lee | |
| 2007/0214755 | A1 | 9/2007 | Corney et al. | |
| 2007/0226947 | A1 | 10/2007 | Kang | |
| 2007/0226948 | A1 | 10/2007 | Due | |
| 2007/0245511 | A1 | 10/2007 | Hahm | |
| 2009/0044370 | A1 | 2/2009 | Won | |
| 2009/0049640 | A1 | 2/2009 | Lee | |
| 2009/0151306 | A1 | 6/2009 | Lin | |
| 2009/0183633 | A1 | 7/2009 | Schiller | |
| 2009/0223183 | A1 | 9/2009 | Lin | |
| 2009/0229230 | A1 | 9/2009 | Cheng | |
| 2010/0107355 | A1 | 5/2010 | Wen | |
| 2012/0084937 | A1 | 4/2012 | Won | |
| 2013/0205520 | A1 | 8/2013 | Kapoor | |
| 2013/0212984 | A1 | 8/2013 | Reckin et al. | |
| 2013/0298350 | A1 | 11/2013 | Schnittman | |
| 2013/0335900 | A1 | 12/2013 | Jang | |
| 2014/0053351 | A1 | 2/2014 | Kapoor | |
| 2014/0059983 | A1 | 3/2014 | Ho | |
| 2014/0130272 | A1 | 5/2014 | Won | |
| 2014/0184144 | A1 | 7/2014 | Henricksen | |
| 2014/0229008 | A1 | 8/2014 | Schnittman | |
| 2015/0057800 | A1 | 2/2015 | Cohen | |
| 2016/0075021 | A1 | 3/2016 | Cohen | |
| 2016/0113469 | A1 | 4/2016 | Schnittman | |
| 2016/0143500 | A1 | 5/2016 | Fong | |
| 2016/0183752 | A1 | 6/2016 | Morin | |
| 2016/0374528 | A1 | 12/2016 | Morin | |
| 2017/0055796 | A1 | 3/2017 | Won | |
| 2017/0072564 | A1 | 3/2017 | Cohen | |
| 2017/0105592 | A1 | 4/2017 | Fong | |
| 2017/0150861 | A1 | 6/2017 | Tanaka et al. | |
| 2017/0209011 | A1 | 7/2017 | Robinson | |
| 2017/0217019 | A1 | 8/2017 | Cohen | |
| 2017/0273532 | A1 | 9/2017 | Machida | |
| 2017/0319033 | A1 | 11/2017 | Hyun | |
| 2018/0008111 | A1 | 1/2018 | Morin | |
| 2018/0014709 | A1 | 1/2018 | Obrien | |
| 2018/0064303 | A1 | 3/2018 | Meggle | |
| 2018/0078107 | A1 * | 3/2018 | Gagnon | A47L 9/0488 |
| 2018/0125312 | A1 | 5/2018 | Kuhe | |
| 2018/0177358 | A1 | 6/2018 | Conrad | |
| 2018/0177367 | A1 | 6/2018 | Amaral | |
| 2018/0199776 | A1 | 7/2018 | Sato | |
| 2018/0228335 | A1 * | 8/2018 | Miller | B60L 53/36 |

FOREIGN PATENT DOCUMENTS

| | | | |
|---|---|---|---|
| CN | 201719179 | U | 1/2011 |
| CN | 101984910 | A | 3/2011 |
| CN | 201840420 | U | 5/2011 |
| CN | 102125407 | A | 7/2011 |
| CN | 103316528 | B | 9/2013 |
| CN | 203852305 | U | 10/2014 |
| CN | 204654815 | U | 9/2015 |
| CN | 105078367 | A | 11/2015 |
| CN | 1212095 | C | 12/2017 |
| CN | 107468159 | A | 12/2017 |
| DE | 19704468 | A1 | 8/1998 |
| DE | 20311505 | U1 | 9/2003 |
| DE | 102007059591 | A1 | 6/2009 |
| DE | 102013108564 | A1 | 3/2015 |
| EP | 0935437 | B1 | 6/2002 |
| EP | 2023788 | A2 | 2/2009 |
| EP | 1535564 | B1 | 8/2009 |
| EP | 1743562 | B1 | 9/2011 |
| EP | 1707094 | B1 | 4/2012 |
| EP | 1959809 | B1 | 5/2014 |
| EP | 2459043 | B1 | 9/2015 |
| EP | 2225993 | B1 | 2/2016 |
| EP | 2548489 | B1 | 3/2016 |
| EP | 2394553 | B1 | 4/2016 |
| EP | 2548492 | B1 | 4/2016 |
| EP | 3031377 | B1 | 8/2018 |
| GB | 539973 | A | 10/1941 |
| GB | 2449484 | B | 11/2008 |
| GB | 2459300 | B | 10/2009 |
| GB | 2487387 | B | 7/2012 |
| GB | 2522658 | B | 8/2015 |
| JP | 06072502 | B2 | 10/1941 |
| JP | 06088784 | B2 | 10/1941 |
| JP | 2003038398 | A | 2/2003 |
| JP | 2003180587 | A | 2/2003 |
| JP | 2003339593 | A | 12/2003 |
| JP | 2003339594 | A | 12/2003 |
| JP | 2003339595 | A | 12/2003 |
| JP | 2003339596 | A | 12/2003 |
| JP | 2005218512 | A | 8/2005 |
| JP | 2006340935 | A | 12/2006 |
| JP | 2007089755 | A | 4/2007 |
| JP | 2008154801 | A | 7/2008 |
| JP | 2008194177 | A | 8/2008 |
| JP | 2008246154 | A | 10/2008 |
| JP | 2014079455 | A | 5/2014 |
| KR | 100572866 | B1 | 4/2006 |
| KR | 100572877 | B1 | 4/2006 |
| KR | 100634805 | B1 | 10/2006 |
| KR | 20070012109 | A | 1/2007 |
| KR | 100880492 | B1 | 1/2009 |
| KR | 101134243 | B1 | 4/2012 |
| KR | 101306738 | B1 | 9/2013 |
| KR | 100070755 | B1 | 5/2014 |
| WO | WO2011025071 | A1 | 3/2011 |
| WO | WO2012/094617 | A2 | 7/2012 |
| WO | WO2012086950 | A2 | 10/2012 |
| WO | WO2016206759 | A1 | 12/2016 |

(56) References Cited

FOREIGN PATENT DOCUMENTS

| | | | |
|---|---|---|---|
| WO | WO2017123136 | A1 | 7/2017 |
| WO | WO2018118072 | A1 | 6/2018 |

OTHER PUBLICATIONS

International Search Report and Written Opinion relating to corresponding application PCT/US2019/042704, dated Sep. 30, 2019.
Irobot Master, iRobot Master—iRobot Roomba Robot Not Charging Docking Station Solution. YouTube, Dec. 26, 2015 (retrieved from Intenet Sep. 1, 2019): https://www.youtube.com/watch?v=MwQg6yklePo.
International Search Report and Written Opinion dated Jul. 5, 2019, received in corresponding PCT Application No. PCT/US19/30214, 9 pgs.

* cited by examiner

DOCKING STATION FOR ROBOTIC CLEANER

CROSS-REFERENCE TO RELATED APPLICATIONS

The present application is a continuation application of co-pending application Ser. No. 16/400,657 filed May 1, 2019, which claims the benefit of U.S. Provisional Application Ser. No. 62/665,364, filed on May 1, 2018, entitled DOCKING STATION FOR ROBOTIC CLEANER, which is fully incorporated herein by reference.

TECHNICAL FIELD

The present disclosure is generally related to robotic cleaners and more specifically related to docking stations capable of evacuating debris from a robotic vacuum cleaner.

BACKGROUND INFORMATION

Robotic cleaners (e.g., robotic vacuum cleaners) are configured to autonomously clean a surface. For example, a user of a robotic vacuum cleaner may dispose the robotic vacuum cleaner in a room and instruct the robotic vacuum cleaner to commence a cleaning operation. While cleaning, the robotic vacuum cleaner collects debris and deposits them in a dust cup for later disposal by a user. Depending on the level of debris within the room and the size of the dust cup a user may have to frequently empty the dust cup (e.g., after each cleaning operation). Thus, while a robotic vacuum cleaner may remove user involvement from the cleaning process, the user may still be required to frequently empty the dust cup. As a result, some of the convenience of a robotic vacuum cleaner may be sacrificed due to frequently requiring a user to empty the dust cup.

BRIEF DESCRIPTION OF THE DRAWINGS

These and other features and advantages will be better understood by reading the following detailed description, taken together with the drawings, wherein.

DETAILED DESCRIPTION

The present disclosure is generally related to robotic cleaners and more specifically to docking stations for robotic vacuum cleaners. Robotic vacuum cleaners autonomously travel around a space and collect debris gathered on a surface. The debris may be deposited within a dust cup for later disposal. For example, when the robotic vacuum cleaner docks with a docking station, debris from the dust cup may be transferred from the dust cup to the docking station. The volume available for debris storage may be greater in the docking station than the dust cup, allowing the user to dispose of collected debris less frequently.

There is provided herein a docking station capable of suctioning debris from a dust cup of a robotic vacuum and into the docking station. The docking station includes a filter medium capable of collecting the debris from the dust cup. When the filter medium collects a predetermined quantity of debris, the filter medium is processed such that it forms a closed bag, the closed bag being configured to hold the debris. The closed bag may then be deposited within a collection bin for later disposal. The collection bin may hold multiple closed bags. Each closed bag may contain a volume of debris equal to the volume of debris held in one or more dust cups. As a result, the robotic vacuum cleaner may be able to carry out multiple cleaning operations before a user needs to dispose of collected debris. Furthermore, by enclosing the collected debris in individual bags, emptying of the collection bin may be a more sanitary process when compared to situations where the debris are not stored in a closed bag.

Figure 1:
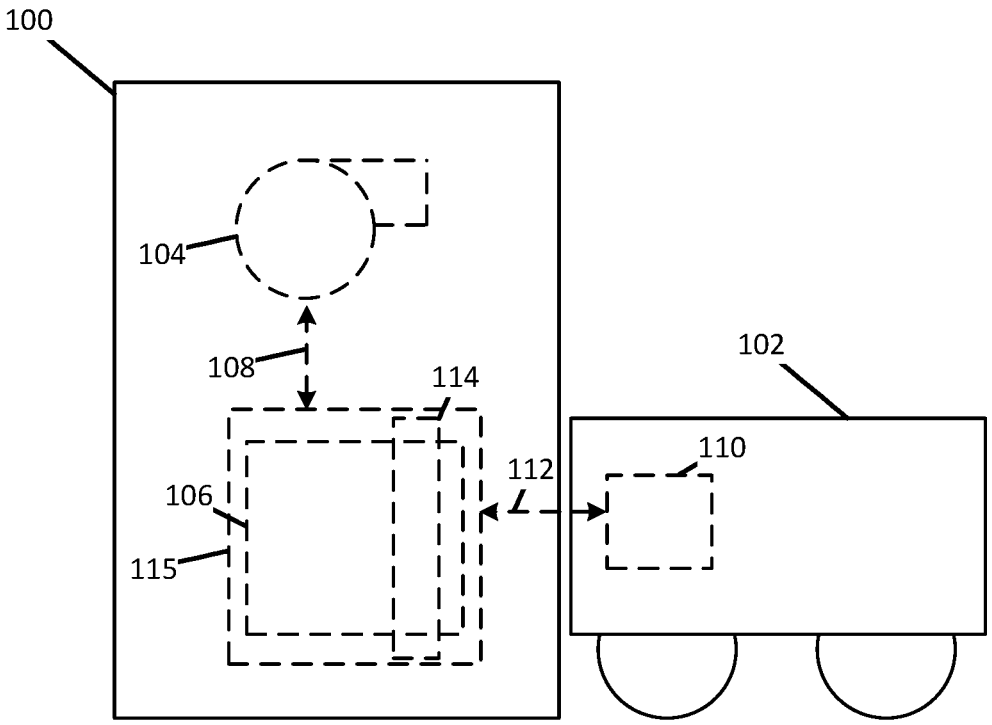
FIG. 1 shows a schematic view of a docking station having a robotic vacuum cleaner docked thereto, consistent with embodiments of the present disclosure.

FIG. 1 shows a schematic example of a docking station 100 for a robotic vacuum cleaner 102. As shown, the docking station 100 includes a suction motor 104 (shown in hidden lines) fluidly coupled to a filter system 115 (shown in hidden lines) having a filter medium 106 (shown in hidden lines) using a first fluid flow path 108 (shown schematically). The filter medium 106 is fluidly coupled to a dust cup 110 (shown in hidden lines) of the robotic vacuum cleaner 102 using a second fluid flow path 112 (shown schematically). In other words, the suction motor 104 is fluidly coupled to the dust cup 110. When the suction motor 104 is activated (e.g., in response to detecting a presence of the robotic vacuum cleaner 102 at the docking station 100), an airflow is generated that extends from the dust cup 110, through the filter medium 106, and into the suction motor 104. In other words, the suction motor 104 is configured to suction debris from the dust cup 110 of the robotic vacuum cleaner 102. For example, the suction motor 104 may be configured to suction debris from the dust cup 110 through a dirty air inlet to the dust cup 110, through a selectively openable opening in the dust cup 110, and/or the like. Debris within the dust cup 110 is entrained in the airflow and deposited on the filter medium 106. In other words, the filter medium 106 collects debris suctioned from the dust cup 110. When the dust cup 110 is substantially emptied of debris, the suction motor 104 may shut off. As a result, the dust cup 110 can be emptied without user intervention. In addition to being used to collect debris, the filter medium 106 may also act as a pre-motor filter and prevent or mitigate the flow of dirty air into the suction motor 104.

The filter medium 106 may be configured to form a closed bag when it is determined that the filter medium 106 has collected a predetermined quantity of debris. The predetermined quantity of debris may correspond to a maximum quantity of debris that the filter medium 106 may hold while still being able to form a closed bag (e.g., the filter medium 106 is full). In some instances, the docking station 100 may include a sealer 114 (shown in hidden lines) configured to couple (e.g., seal) one or more portions of the filter medium 106 together such that the closed bag is formed. The sealer 114 may be part of the filter system 115. Therefore, the filter system 115 may generally be described as being configured to process the filter medium 106 and form a closed bag when, for example, it is determined that the filter medium 106 has collected a predetermined quantity of debris.

In some instances, the filter medium 106 may define a bag having at least one open end. For example, the bag may be disposed within the docking station 100 and, when the bag is determined to have collected a predetermined quantity of debris, the sealer 114 seals the open end such that the filter medium 106 forms a closed bag. By way of further example, the filter medium 106 may be configured such that it can be folded over on itself (e.g., the filter medium 106 may be in the form of a sheet) and the side(s) sealed together using the sealer 114 such that a bag having at least one open end may be formed within the docking station 100. Alternatively, the filter medium 106 may be configured to be folded over itself, after a predetermined quantity of debris has collected on the filter medium 106, such that a closed bag can be formed in response to the filter medium 106 collecting a predetermined quantity of debris.

Figure 2:
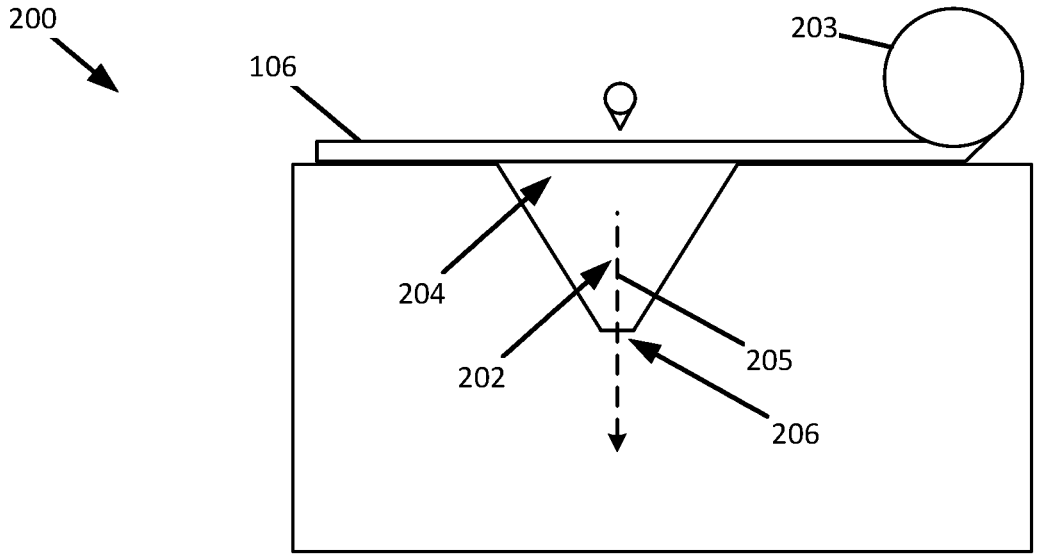
FIG. 2 shows a schematic view of a filter system capable of being used with the docking station of FIG. 1, consistent with embodiments of the present disclosure.

FIGS. 2-7 collectively show a schematic representation of the filter medium 106 being formed into a bag having at least one open end, which is then filled with debris from the dust cup 110, and is then formed into a closed bag. FIG. 2 shows a cross-sectional schematic view of a filter system 200 which may be an example of the filter system 115 of FIG. 1. As shown in FIG. 2, the filter system 200 may include the filter medium 106 and a suction cavity 202. At least a portion of the filter medium 106 may define a filter roll 203, wherein the filter roll 203 is rotatably coupled to a portion of the filter system 200. The filter roll 203 may be unrolled such that the filter medium 106 extends over the suction cavity 202. The suction cavity 202 has a first open end 204 for receiving at least a portion of the filter medium 106 and a second open end 206 fluidly coupled to the suction motor 104 for drawing air through the filter medium 106. The flow path through the filter system 200 is generally illustrated by arrow 205.

Figure 3:
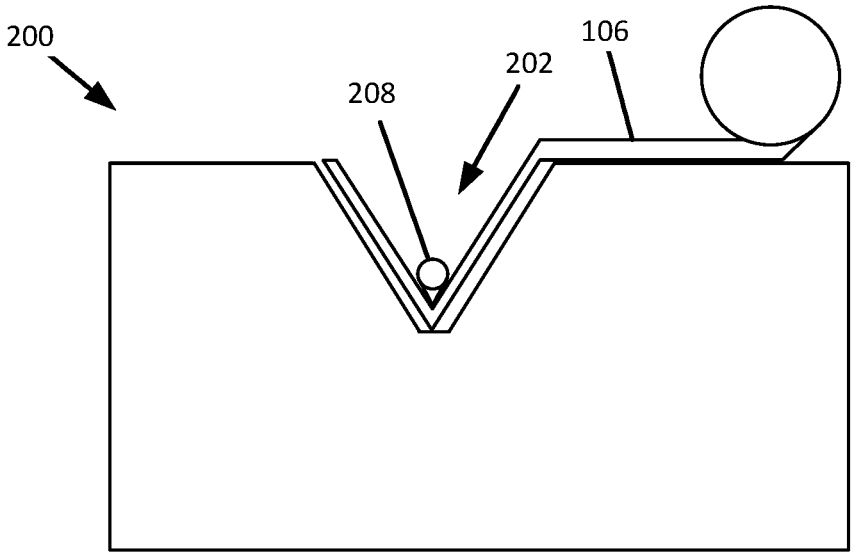
FIG. 3 shows another schematic view of the filter system of FIG. 2 having a filter medium disposed within a suction cavity, consistent with embodiments of the present disclosure.

FIG. 3 shows another cross-sectional schematic view of the filter system 200. As shown in FIG. 3, the filter system 200 includes a pusher 208. The pusher 208 is configured to move towards the filter medium 106, engage the filter medium 106, and urge the filter medium 106 into the suction cavity 202. As a result, the filter medium 106 may generally be described a defining a V-shape or a U-shape. The pusher 208 may have any cross-sectional shape. For example, the cross-sectional shape of the pusher 208 may be wedge shaped, circular shaped, square shaped, pentagonal shaped, and/or any other suitable shape.

Figure 4:
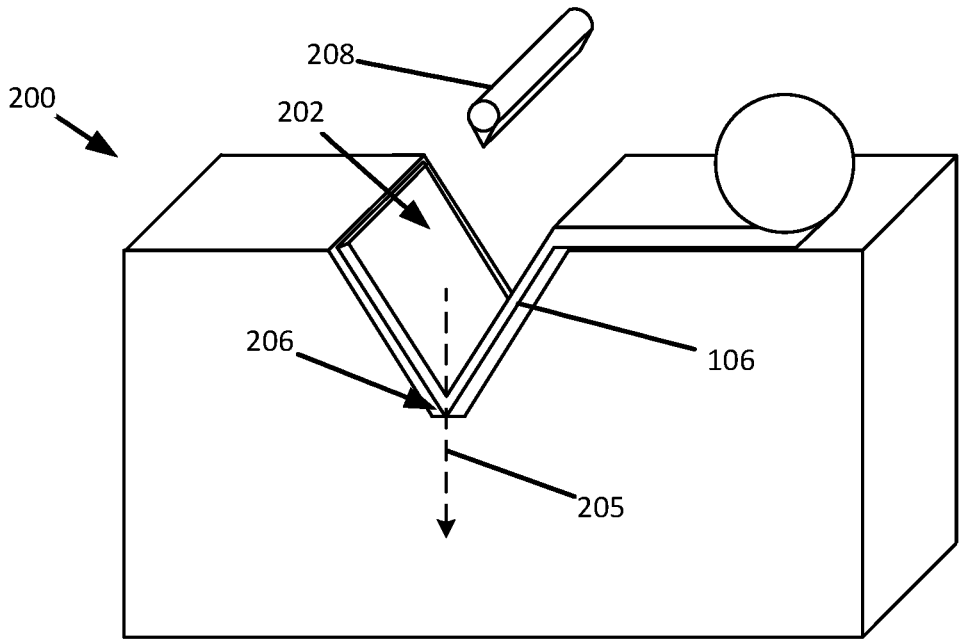
FIG. 4 shows a schematic perspective view of the filter system of FIG. 3, consistent with embodiments of the present disclosure.

FIG. 4 shows a schematic perspective view of the filter system 200. As shown, when the pusher 208 moves away from the filter medium 106 (e.g., retracts), the filter medium 106 remains within the suction cavity 202. The pusher 208 may be configured to retract when a portion of the filter medium 106 is adjacent and/or extends into the second open end 206 of the suction cavity 202. As a result, a substantial portion of the air flowing through the filter system 200 may pass through the filter medium 106 before passing through the second open end 206 of the suction cavity 202 (e.g., as shown by the arrow 205). As a result, the filter medium 106 may act as a pre-motor filter in addition to being configured to form a bag for holding debris.

Figure 5:
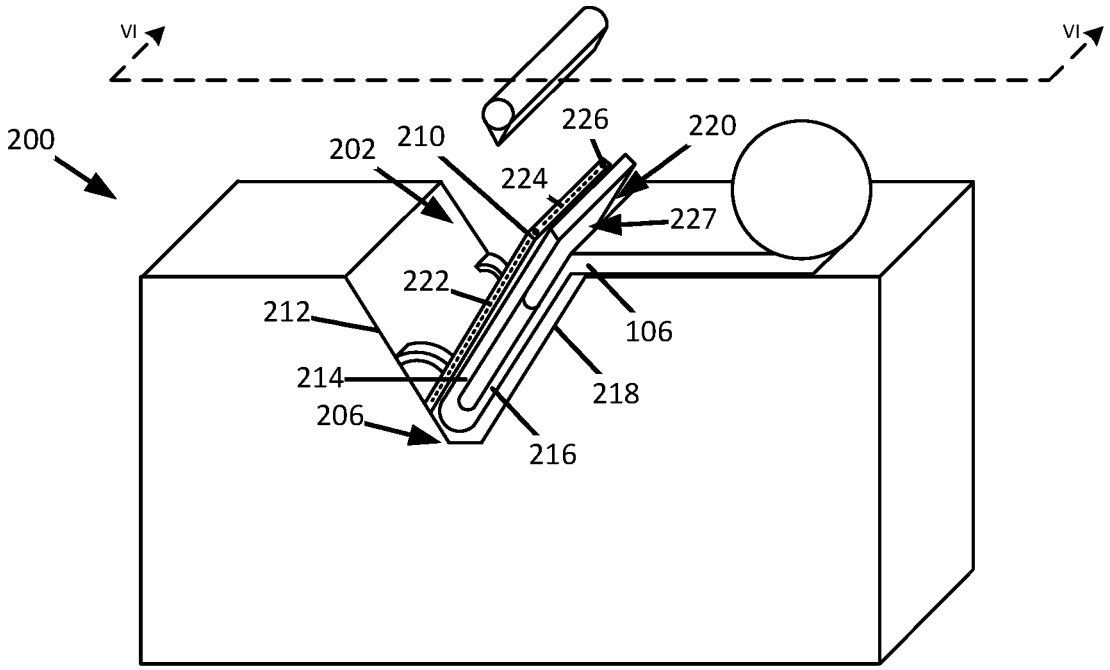
FIG. 5 shows a schematic perspective view of the filter system of FIG. 4 having a filter medium being urged into itself to form a bag having an open end, consistent with embodiments of the present disclosure.

FIG. 5 shows a schematic perspective view of the filter system 200. As shown, a compactor 210 extends outwardly from a first cavity sidewall 212 of the suction cavity 202 and urges a first portion 214 of the filter medium 106 towards a second portion 216 of the filter medium 106 that is adjacent a second cavity sidewall 218 of the suction cavity 202. As shown, the first and second sidewalls 212 and 218 are on opposing sides of the suction cavity 202.

The first portion 214 of the filter medium 106 and the second portion 216 of the filter medium 106 may generally be described as residing on opposing sides of the second open end 206 of the suction cavity 202. As such, when the first portion 214 is urged into contact with the second portion 216, a pocket 220 is formed between the first and second portions 214 and 216 of the filter medium 106.

When the pocket 220 is formed between the first and second portions 214 and 216 of the filter medium 106, the compactor 210 is configured to couple the first and second portions 214 and 216 together such that the filter medium 106 defines a bag having at least one open end. In other words, the compactor 210 is configured to couple the first portion 214 to the second portion 216 of the filter medium 106. The first and second portions 214 and 216 can be joined using, for example, adhesive bonding, mechanical fastener(s) such as staples or thread, and/or any other suitable form of joining.

The filter medium 106 may include filaments, a film, threads, and/or the like that, when exposed to a heat source, melt to form a bond with an engaging material. For example, the filter medium 106 may include filaments embedded therein that are exposed to a heat source when the first and second portions 214 and 216 of the filter medium 106 come into engagement such that a bond is formed between the first and second portions 214 and 216. The filaments, film, threads, and/or the like may be formed from polypropylene, polyvinyl chloride, and/or any other suitable material. For example, the filter medium 106 may be a filter paper having filaments, film, and/or threads coupled to and/or embedded therein that are made of polypropylene and/or polyvinyl chloride.

The compactor 210 can include at least three resistive elements. For example, the compactor 210 may include a first resistive element 222, a second resistive element 224, and a third resistive element 226 that collectively define the sealer 114. As shown, the second resistive element 224 can extend transverse (e.g., perpendicular) to the first and third resistive elements 222 and 226. The resistive elements 222, 224, and 226 are configured to generate heat in response to the application of a current thereto. The generated heat is sufficient to melt, for example, polypropylene filaments embedded within the filter medium 106 such that the first and second portions 214 and 216 of the filter medium can be bonded together. However, the resistive elements 222, 224, and 226 may be configured such that the resistive elements 222, 224, and 226 generate insufficient heat to combust the material forming the filter medium 106 and/or the debris collected by the filter medium 106.

One or more of the first, second, and/or third resistive elements 222, 224, and 226 may be controllable independently of the others of the first, second, and/or third resistive elements 222, 224, and 226. For example, the first and third resistive elements 222 and 226 may be independently controllable from the second resistive element 224 such that the pocket 220 defined between the first and second portions 214 and 216 of the filter medium 106 defines an interior volume of a bag having a single open end 227. The second resistive element 224 may be used to form a closed bag (e.g., when the pocket 220 is determined to be filled with debris).

Figure 6:
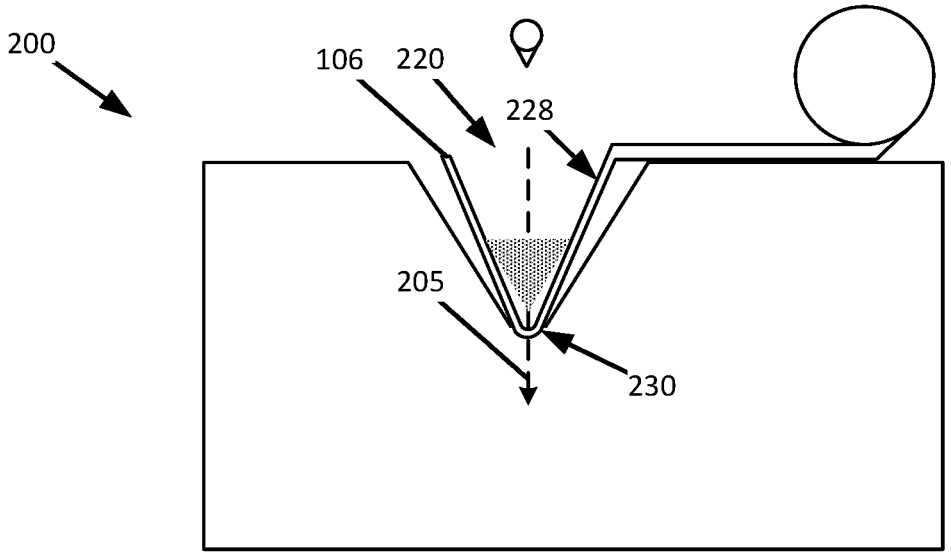
FIG. 6 shows a schematic cross-sectional view of the filter system of FIG. 5 as taken along the line VI-VI of FIG. 5, wherein the filter medium has the form of a bag with an open end and having debris disposed therein, consistent with embodiments of the present disclosure.

FIG. 6 shows a schematic cross-sectional view of the filter system 200 taken along the line VI-VI of FIG. 5. As shown, the flow path extends along the arrow 205 such that debris laden air from the dust cup 110 of the robotic vacuum cleaner 102 enters the filter medium 106 on a dirty air side 228 of the filter medium and deposits debris within the pocket 220. The air then exits the filter medium 106 from a clean air side 230 of the filter medium 106 and is discharged from the docking station 100. When the pocket 220 is determined to be filled (e.g., by detecting a change in pressure across the filter medium, a weight of the collected debris, a volume of collected debris, and/or any other suitable method), removal of debris from the dust cup 110 may be discontinued and any open ends of the pocket 220 may be closed (e.g., sealed) such that the filter medium 106 defines a closed bag.

Figure 7:
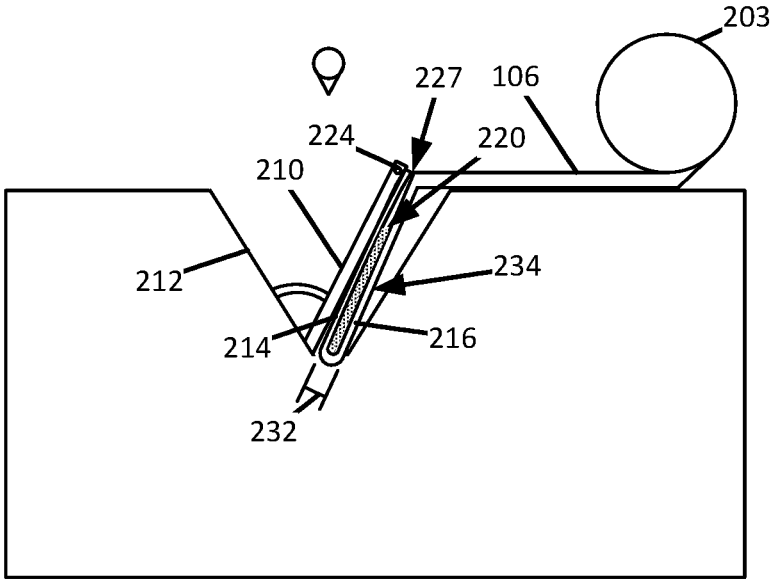
FIG. 7 shows a schematic cross-sectional view of the filter system of FIG. 5 as taken along the line VI-VI of FIG. 5, wherein the open end of the bag defined by the filter medium is being closed such that a closed bag is formed, consistent with embodiments of the present disclosure.

For example, and as shown in FIG. 7, when the pocket 220 is determined to be full, the compactor 210 may extend from the first sidewall 212 and engage the first portion 214 of the filter medium 106 such that the first portion 214 of the filter medium 106 is urged into engagement with the second portion 216 of the filter medium 106 at a region adjacent the open end 227. As shown, the compactor 210 may also compact and/or distribute the debris within the pocket 220 such that an overall volume of the pocket 220 may be reduced and/or such that a thickness 232 of the pocket 220 is reduced.

When the first portion 214 engages the second portion 216 of the filter medium 106, the second resistive element 224 may be activated such that the first and second portions 214 and 216 are bonded to each other at the open end 227, closing the open end 227 of the pocket 220. As a result, the filter medium 106 may generally be described as defining a closed bag 234. In other words, the compactor 210 can generally be described as being configured to cause a seal to be formed at the open end 227 of the pocket 220 such that the closed bag 234 is formed in response to a predetermined quantity of debris being collected within the pocket 220 defined by the filter medium 106.

Once formed, the closed bag 234 may be separated from the filter roll 203 and removed from the suction cavity 202. The closed bag 234 may be separated from the filter roll 203 by, for example, cutting (e.g., using a blade), burning (e.g., by heating the second resistive element 224 until the filter medium 106 burns), tearing (e.g., along a perforated portion of the filter medium 106) and/or any other suitable method of severing. For example, the compactor 210 can be configured to sever the filter medium 106 in response to the closed bag 234 being formed such the closed bag 234 is separated from the filter roll 203. Once removed, additional filter medium 106 may be unrolled from the filter roll 203 and be deposited in the suction cavity 202.

Figure 8A:
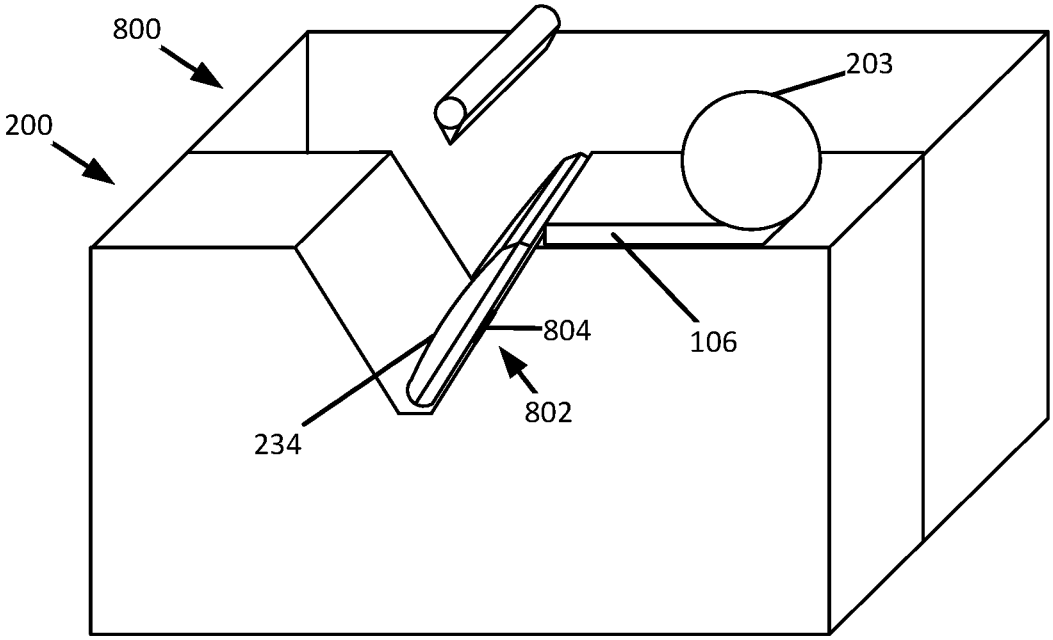
FIG. 8A shows a schematic perspective view of the filter system of FIG. 5 having a collection bin coupled thereto for receiving closed bags, consistent with embodiments of the present disclosure.

With reference to FIG. 8A, the closed bag 234 may be deposited in a collection bin 800 disposed within the docking station 100 for later disposal. The collection bin 800 may be coupled to the filter system 200 and be configured to receive a plurality of closed bags 234. Each closed bag 234 may be transferred automatically to the collection bin 800 using a conveyor 802. In other words, the conveyor 802 is configured to urge the closed bag 234 into the collection bin 800. For example, the conveyor 802 may include a driven belt 804 that engages the closed bag 234. When activated, the driven belt 804 is configured to urge the closed bag 234 towards the collection bin 800 such that the closed bag 234 is deposited within the collection bin 800. Additionally, or alternatively, the conveyor 802 may include, for example, a push arm configured to push the closed bag 234 in a direction of the collection bin 800. Alternatively, the closed bag 234 may be deposited in the collection bin 800 by action of a user.

Figure 8B:
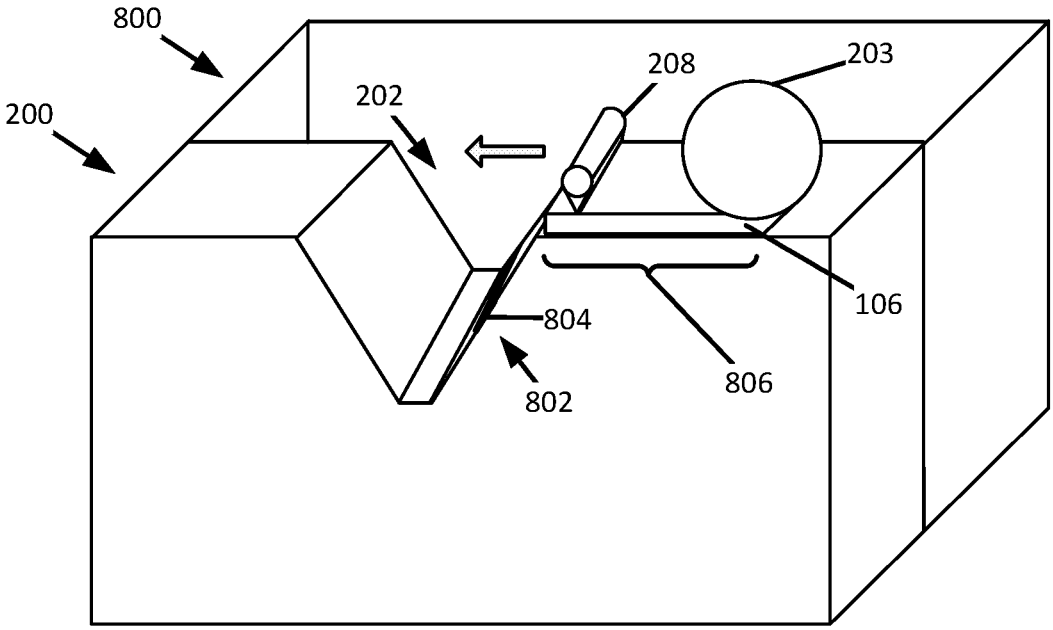
FIG. 8B shows a schematic perspective view of the filter system of FIG. 5, wherein additional filter medium is being unrolled from the filter roll, consistent with embodiments of the present disclosure.

In response to the closed bag 234 being urged into the collection bin 800, the pusher 208 may move into a position that causes the pusher 208 to engage (e.g., contact) a remaining unrolled portion 806 of the filter medium 106 (e.g., as shown in FIG. 8B). When engaging the filter medium 106, the pusher 208 can be configured to temporarily couple (e.g., using one or more actuating teeth, suction force generated through the pusher 208, heating elements to temporarily melt a portion of the filter medium 106 such that the filter medium 106 bonds to the pusher 208, and/or any other suitable form of coupling) to the remaining unrolled portion 806 of the filter medium 106. When coupled to the remaining unrolled portion 806, the pusher 208 can be configured to move in a direction away from the filter roll 203 such that an additional quantity of the filter medium 106 is unrolled from the filter roll 203. When the pusher 208 unrolls a sufficient quantity of the filter medium 106 such that the filter medium 106 extends over the suction cavity 202, the pusher 208 can disengage the filter medium 106 and return to a central location over the suction cavity 202 such that the pusher 208 can urge the filter medium 106 into the suction cavity 202.

When the collection bin 800 is full, a user may empty the collection bin 800. In some instances, the emptying of the collection bin 800 may coincide with the replacement of the filter roll 203. The docking station 100 may also include an indicator (e.g., a light, a sound generator, and/or another indicator) that is configured to indicate when the collection bin 800 is full. Additionally, or alternatively, the docking station 100 may include an indicator that is configured to indicate when an insufficient quantity of the filter medium 106 remains (e.g., there is not sufficient filter medium 106 remaining to form a closed bag).

Figure 9:
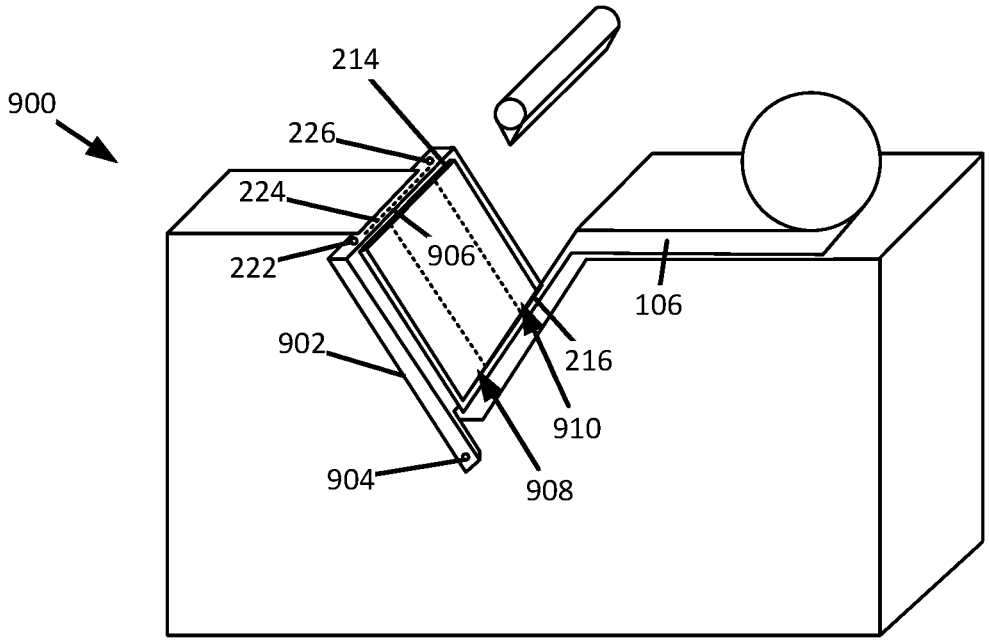
FIG. 9 shows a schematic perspective view of a filter system capable of being used with the docking station of FIG. 1, consistent with embodiments of the present disclosure.

FIG. 9 shows a schematic perspective view of an example of a filter system 900, which may be an example of the filter system 115 of FIG. 1. As shown, the filter system 900 includes a plurality of sealing arms 902 configured to pivot about a pivot point 904 and urge the first portion 214 of the filter medium 106 into the second portion 216 of the filter medium 106. Each of the sealing arms 902 may form a portion of the sealer 114 (e.g., the sealing arms 902 may include the first and third resistive elements 222 and 226, respectively). In some instances, the plurality of sealing arms 902 may be connected to each other by, for example, a cross bar 906 extending behind the first portion 214 of the filter medium 106. The cross bar 906 may also form a portion of the sealer 114 (e.g., the cross bar 906 may include the second resistive element 224).

As shown, the pivot point 904 is disposed between the first and second portions 214 and 216 of the filter medium 106. Such a configuration, may encourage a substantially continuous seal to be formed within peripheral regions 908 and 910 of the filter medium 106 (e.g., a region having a width measuring less than or equal to 10% of a total width of the filter medium 106).

Figure 10:
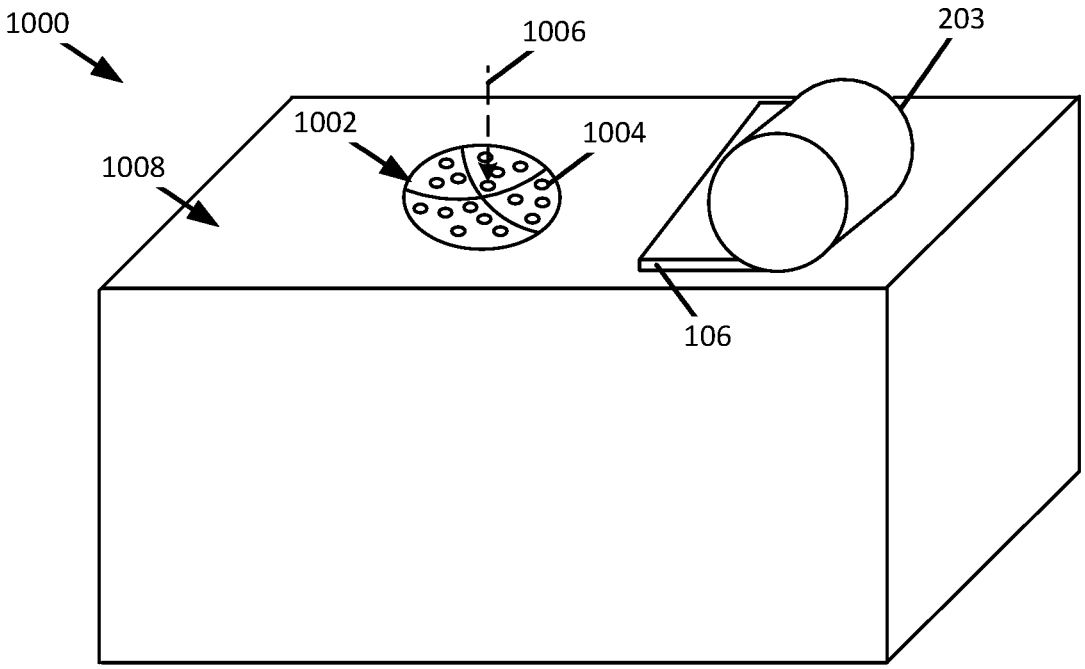
FIG. 10 shows a schematic perspective view of a filter system capable of being used with the docking station of FIG. 1, consistent with embodiments of the present disclosure.

FIG. 10 shows a schematic perspective view of an example of a filter system 1000, which may be an example of the filter system 115 of FIG. 1. As shown, the filter system 1000 includes the filter roll 203 and a depression (or cavity) 1002 having a plurality of suction apertures 1004 fluidly coupled to the suction motor 104 such that air can be drawn through the suction apertures 1004 along an airflow path represented by an arrow 1006. The depression 1002 is defined in a support surface 1008, which supports the filter medium 106 when it is unrolled from the filter roll 203. As such, the filter medium 106 may extend generally parallel to the support surface 1008. As shown, the depression 1002 may define a recess in the support surface 1008 having a depth that measures less than its length and/or width.

Figure 11:
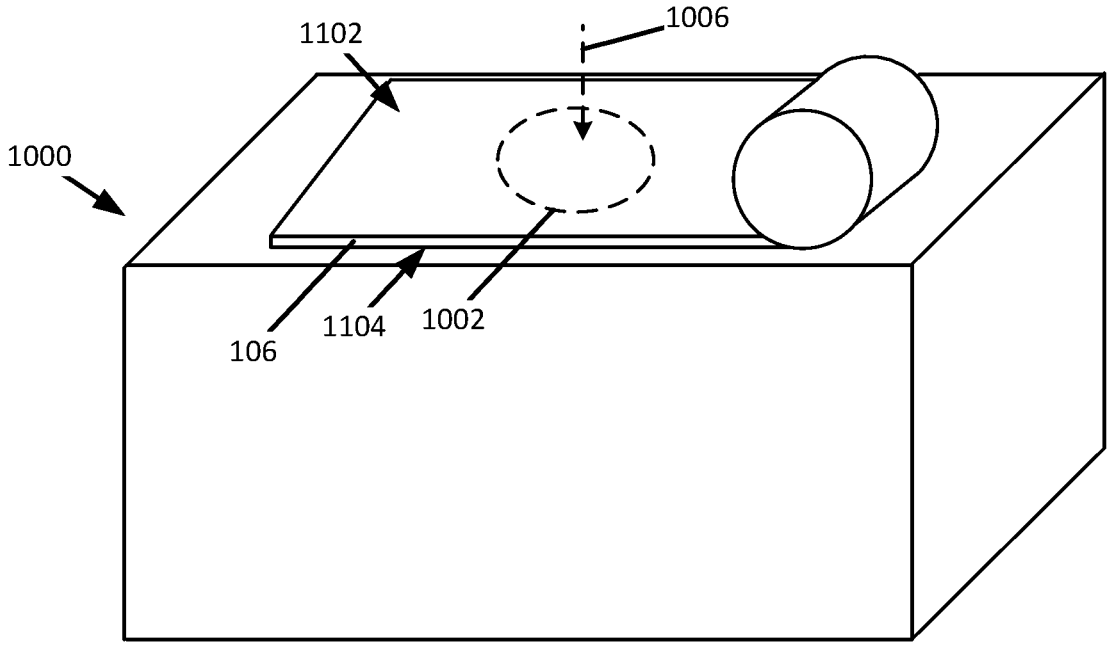
FIG. 11 shows another schematic perspective view of the filter system of FIG. 10, consistent with embodiments of the present disclosure.

FIG. 11 shows a schematic perspective view of the filter system 1000 wherein the filter medium 106 extends over the depression 1002 (shown in hidden lines). As such, the airflow path represented by the arrow 1006 extends from a dirty air side 1102 of the filter medium 106 to a clean air side 1104 of the filter medium 106 and is exhausted from the docking station 100. Debris suctioned from the dust cup 110 of the robotic vacuum cleaner 102 is entrained in the air traveling along the airflow path and is deposited on the filter medium 106.

Figure 12:
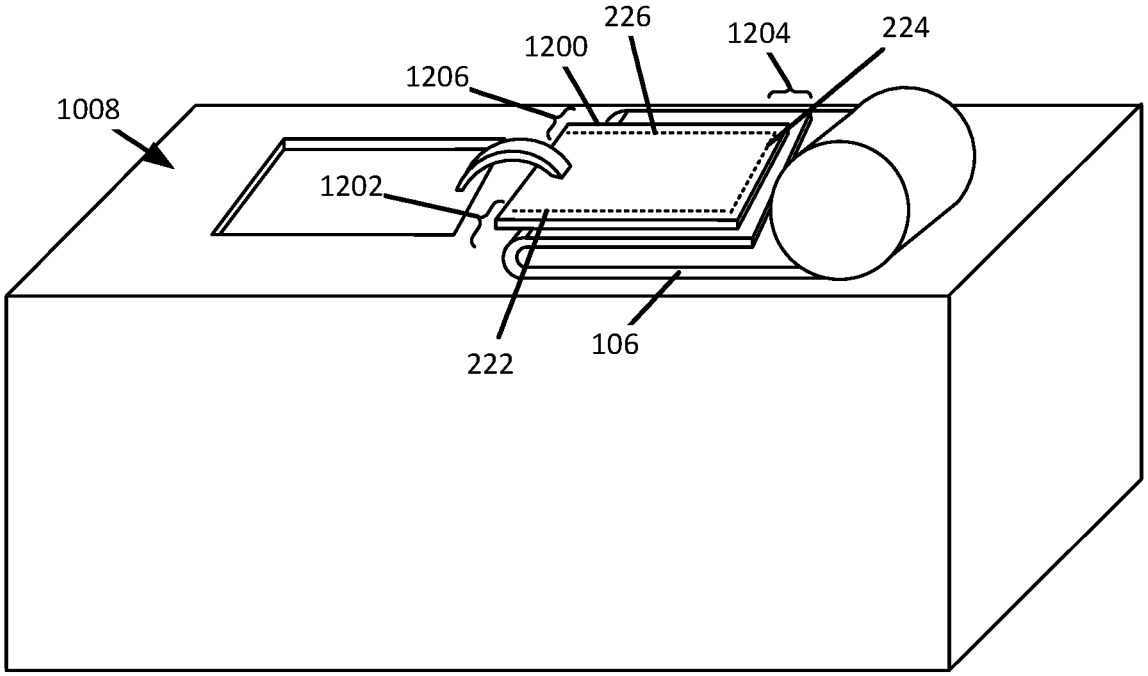
FIG. 12 shows a schematic perspective view of the filter system of FIG. 10, wherein the filter medium is being urged into itself to form a closed bag, consistent with embodiments of the present disclosure.

When a predetermined quantity of debris is deposited on the filter medium 106 (e.g., when the dust cup 110 is emptied and/or when the filter medium 106 is determined to be full), the filter medium 106 may be folded over on itself (e.g., a first portion of the filter medium 106 may be urged into engagement with a second portion of the filter medium 106). For example, and as shown in FIG. 12, a compactor 1200 may extend from the support surface 1008 and urge the filter medium 106 to fold over on itself such that a portion of the filter medium 106 is positioned above another portion of the filter medium 106. As the compactor 1200 folds the filter medium 106 over on itself, debris deposited on the filter medium 106 may be compacted and/or more evenly distributed along the filter medium 106. This may reduce the overall size of a closed bag formed from the filter medium 106. Once folded over on itself, the filter medium 106 may be bonded to itself within peripheral regions 1202, 1204, and 1206 (e.g., a region having a width measuring less than or equal to 10% of a total width of the filter medium 106) such that a closed bag is formed. For example, the compactor 1200 may include the first, second, and third resistive elements 222, 224, and 226 such that the filter medium 106 may be bonded within the peripheral regions 1202, 1204, and 1206, forming a closed bag.

Figure 13:
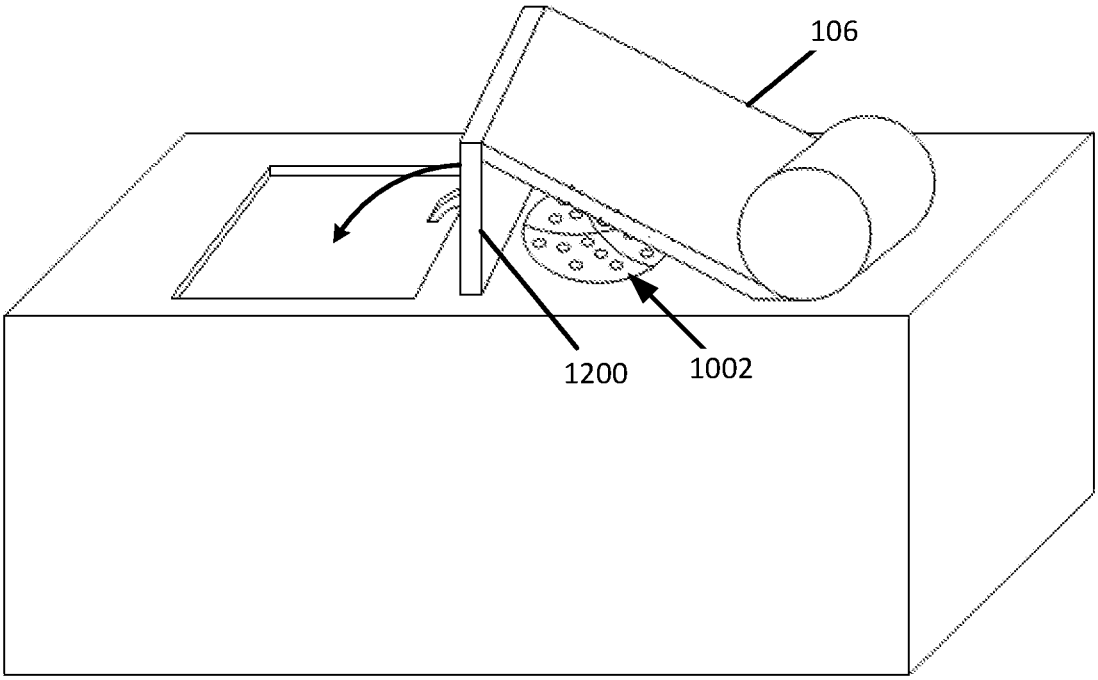
FIG. 13 shows a schematic perspective view of the filter system of FIG. 10, wherein additional filter medium is being unrolled from the filter roll, consistent with embodiments of the present disclosure.

After a closed bag is formed, the closed bag may be removed (e.g., deposited within a collection bin in response to activation of a conveyor such as the conveyor 802 of FIG. 8). As shown in FIG. 13, once the closed bag is removed, the compactor 1200 can be configured to couple to a remaining unrolled portion of the filter medium 106 (e.g., using one or more actuating teeth, suction force generated through the compactor 1200, heating elements to temporarily melt a portion of the filter medium 106 such that the filter medium 106 bonds to at least a portion of the compactor 1200, and/or any other suitable form of coupling). Once coupled to the remaining unrolled portion of the filter medium 106, the compactor 1200 may pivot towards a storage position while pulling the filter medium 106 such that it extends across the depression 1002. Once in the storage position, the compactor 1200 may decouple from the filter medium 106. In some instances, the compactor 1200 may pull the filter medium 106 over the depression 1002 before the closed bag is removed.

Figure 14:
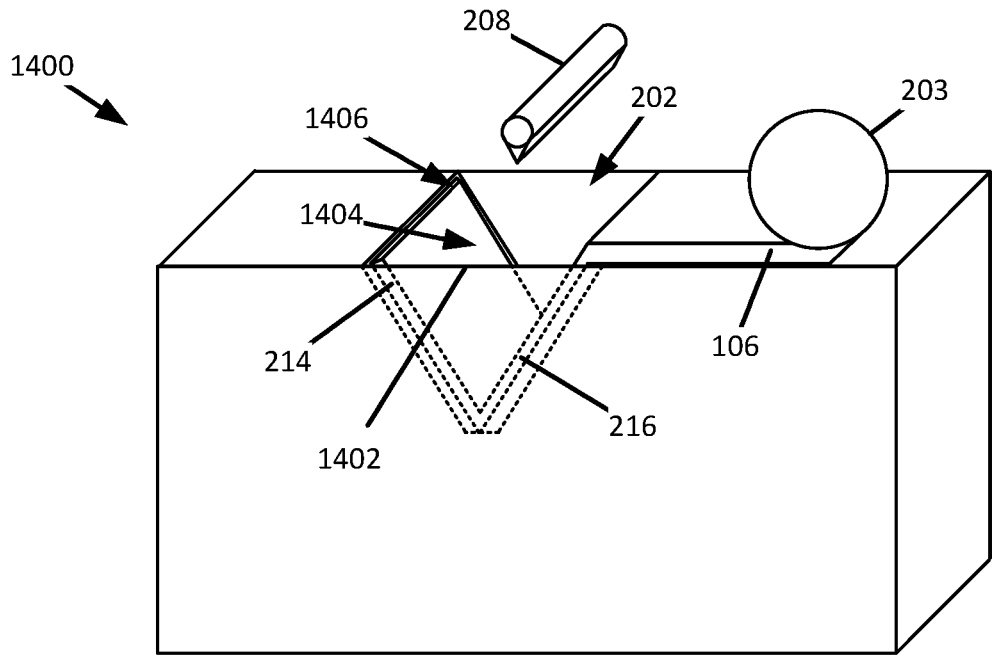
FIG. 14 shows a schematic perspective view of a filter system capable of being used with the docking station if FIG. 1, consistent with embodiments of the present disclosure.
Figure 15:
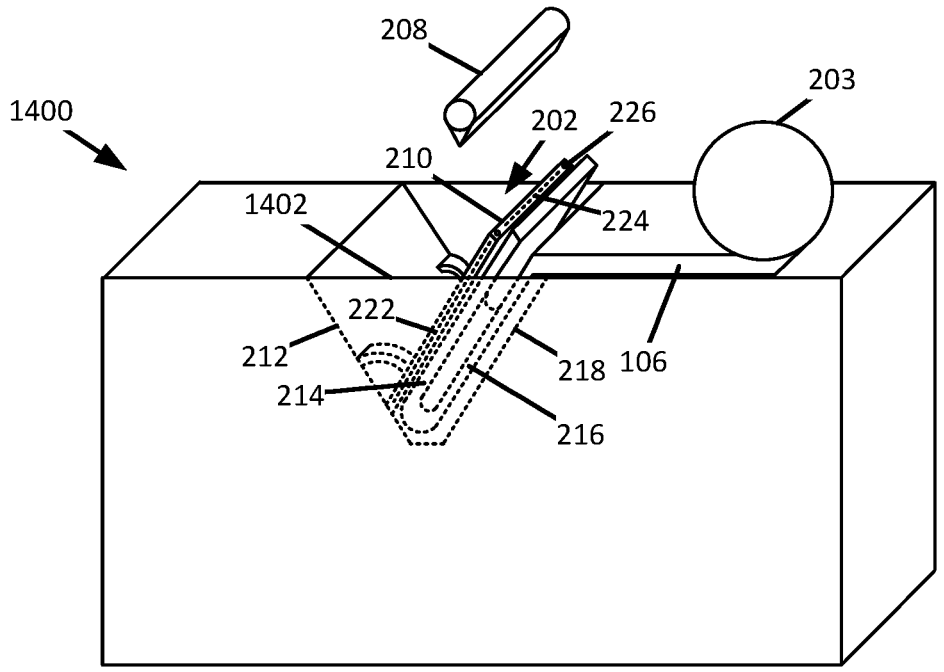
FIG. 15 shows another schematic perspective view of the filter system of FIG. 14, wherein the filter medium is being urged into itself to form a closed bag, consistent with embodiments of the present disclosure.

FIGS. 14 and 15 show a schematic example of a filter system 1400, which may be an example of the filter system 115 of FIG. 1. As shown, the filter system 1400 includes the filter medium 106, the pusher 208, the suction cavity 202, and the compactor 210. As shown, the suction cavity 202 may include a plurality of enclosing sidewalls 1402 that extend transverse (e.g., perpendicular) to the first and second sidewalls 212 and 218 such that the suction cavity 202 has enclosed sides. When the pusher 208 urges the filter medium 106 into the suction cavity 202, a pocket 1404 having an open end 1406 is defined between the filter medium 106 and the sidewalls 1402. Debris suctioned from the dust cup 110 of the robotic vacuum cleaner 102 can be deposited within the pocket 1404. The sidewalls 1402 may prevent or otherwise mitigate debris from escaping the suction cavity 202. In some instances, the sidewalls 1402 may not be included.

When the pocket 1404 has received a predetermined quantity of debris, the compactor 210 can urge the first portion 214 of the filter medium 106 towards the second portion 216 of the filter medium 106 such that the first portion 214 comes into engagement (e.g., contact) with the second portion 216. When the first portion 214 comes into engagement with the second portion 216, the compactor 210 can couple the first portion 214 to the second portion 216 such that a closed bag is formed (e.g., using the resistive elements 222, 224, and 226).

As discussed herein, when the closed bag is formed, the filter medium 106 may be severed such that the closed bag is separated from the filter roll 203. Once separated, the closed bag can be manually or automatically removed. For example, one or more of the sidewalls 1402 may be moveable such that a conveyor (e.g., the conveyor 802) can urge the closed bag into a collection bin (e.g., the collection bin 800). In response to the closed bag being removed from the suction cavity 202, the pusher 208 may be configured to urge a new portion of the filter medium 106 across the suction cavity 202 and to further urge the filter medium 106 into the suction cavity 202, as discussed herein.

According to one aspect of the present disclosure there is provided a docking station for a robotic vacuum cleaner. The docking station may include a suction motor, a collection bin, and a filter system. The suction motor may be configured to suction debris from a dust cup of the robotic vacuum cleaner. The filter system may include a filter medium to collect debris suctioned from the dust cup, a compactor configured to urge a first portion of the filter medium towards a second portion of the filter medium such that a closed bag can be formed, and a conveyor configured to urge the closed bag into the collection bin.

In some cases, the compactor is configured to couple the first portion of the filter medium to the second portion of the filter medium using a sealer. In some cases, the sealer includes at least three resistive elements configured to generate heat. In some cases, a first and a second resistive element extend transverse to a third resistive element. In some cases, the compactor is configured to form a bag having at least one open end. In some cases, the compactor is configured to form a seal at the open end in response to a predetermined quantity of debris being disposed in the bag. In some cases, the filter system includes a cavity over which the filter medium extends. In some cases, the filter system further includes a pusher, the pusher being configured to urge the filter medium into the cavity. In some cases, at least a portion of the filter medium defines a filter roll. In some cases, the compactor is configured to sever the filter medium such that, in response to the closed bag being formed, the compactor severs the filter medium, separating the closed bag from the filter roll.

According to another aspect of the present disclosure there is provided an autonomous cleaning system. The autonomous cleaning system may include a robotic vacuum cleaner having a dust cup for collection of debris and a docking station configured to couple to the robotic vacuum cleaner. The docking station may include a suction motor configured to suction debris from the dust cup of the robotic vacuum cleaner, a collection bin, and a filter system fluidly coupled to the suction motor. The filter system may include a filter medium to collect debris suctioned from the dust cup, a compactor configured to urge a first portion of the filter medium towards a second portion of the filter medium such that a closed bag can be formed, and a conveyor configured to urge the closed bag into the collection bin.

In some cases, the compactor is configured to couple the first portion of the filter medium to the second portion of the filter medium using a sealer. In some cases, the sealer includes at least three resistive elements configured to generate heat. In some cases, a first and a second resistive element extend transverse to a third resistive element. In some cases, the compactor is configured to form a bag having at least one open end. In some cases, the compactor is configured to form a seal at the open end in response to a predetermined quantity of debris being disposed in the bag. In some cases, the filter system includes a cavity over which the filter medium extends. In some cases, the filter system further includes a pusher, the pusher being configured to urge the filter medium into the cavity. In some cases, at least a portion of the filter medium defines a filter roll. In some cases, the compactor is configured to sever the filter medium such that, in response to the closed bag being formed, the compactor severs the filter medium, separating the closed bag from the filter roll.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. An autonomous cleaning system comprising:
- a robotic vacuum cleaner having a dust cup for collection of debris; and
- a docking station configured to couple to the robotic vacuum cleaner, the docking station including:
  - a suction motor configured to suction debris from the dust cup of the robotic vacuum cleaner; and
  - a filter system fluidly coupled to the suction motor, the filter system including:
    - a filter medium to collect debris suctioned from the dust cup; and
    - a compactor configured to urge a first portion of the filter medium towards a second portion of the filter medium such that a closed bag can be formed.

2. The autonomous cleaning system of claim 1, wherein the compactor is configured to couple the first portion of the filter medium to the second portion of the filter medium using a sealer.

3. The autonomous cleaning system of claim 2, wherein the sealer includes at least three resistive elements configured to generate heat.

4. The autonomous cleaning system of claim 3, wherein a first and a second resistive element extend transverse to a third resistive element.

5. The autonomous cleaning system of claim 1, wherein the compactor is configured to form a bag having at least one open end.

6. The autonomous cleaning system of claim 5, wherein the compactor is configured to form a seal at the open end in response to a predetermined quantity of debris being disposed in the bag.

7. The autonomous cleaning system of claim 1, wherein the filter system includes a cavity over which the filter medium extends.

8. The autonomous cleaning system of claim 7, wherein the filter system further includes a pusher, the pusher being configured to urge the filter medium into the cavity.

9. The autonomous cleaning system of claim 8, wherein at least a portion of the filter medium defines a filter roll.

10. A docking station for a robotic vacuum cleaner comprising:
- a suction motor configured to suction debris from a dust cup of the robotic vacuum cleaner;
- a filter medium to collect debris suctioned from the dust cup; and
- a compactor configured to urge a first portion of the filter medium towards a second portion of the filter medium such that a closed bag can be formed.

11. The docking station of claim 10, wherein the compactor is configured to couple the first portion of the filter medium to the second portion of the filter medium using a sealer.

12. A docking station for a robotic vacuum cleaner comprising:
- a suction motor configured to suction debris from a dust cup of the robotic vacuum cleaner; and
- a filter system fluidly coupled to the suction motor, the filter system including:

a filter medium to collect debris suctioned from the dust cup; and a compactor configured to urge a first portion of the filter medium towards a second portion of the filter medium such that a closed bag can be formed.

13. The docking station of claim 12, wherein the compactor is configured to couple the first portion of the filter medium to the second portion of the filter medium using a sealer.

14. The docking station of claim 13, wherein the sealer includes at least three resistive elements configured to generate heat.

15. The docking station of claim 14, wherein a first and a second resistive element extend transverse to a third resistive element.

16. The docking station of claim 12, wherein the compactor is configured to form a bag having at least one open end.

17. The docking station of claim 16, wherein the compactor is configured to form a seal at the open end in response to a predetermined quantity of debris being disposed in the bag.

18. The docking station of claim 12, wherein the filter medium extends over a cavity.

19. The docking station of claim 18 further comprising a pusher, the pusher being configured to urge the filter medium into the cavity.

20. The docking station of claim 12, wherein at least a portion of the filter medium defines a filter roll.

* * * * *